US006081288A

United States Patent [19]

Kojima

[11] Patent Number: 6,081,288

[45] **Date of Patent: *Jun. 27, 2000**

[54] THERMAL RECORDING FILMS AND METHOD OF THERMAL IMAGE RECORDING USING THE SAME

[75] Inventor: Tetsuya Kojima, Kanagawa, Japan

[73] Assignee: Fuji Photo Film Co., Ltd., Kanagawa, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/745,917

[22] Filed: Nov. 8, 1996

[30] Foreign Application Priority Data

Nov. 9, 1995 [JP] Japan ..... 7-291533

[51] Int. Cl.[7] ..... B41M 5/26

[52] U.S. Cl. ..... 347/221; 503/200

[58] Field of Search ..... 347/221, 188; 5/26, 28; 503/200, 208; 430/533

[56] References Cited

U.S. PATENT DOCUMENTS

| | | | |
|---|---|---|---|
| 3,615,554 | 10/1971 | Takenaka | 430/533 |
| 4,711,874 | 12/1987 | Yuyama et al. | 503/206 |
| 4,996,537 | 2/1991 | Kishimi | 347/188 |
| 5,143,904 | 9/1992 | Minato et al. | 503/227 |
| 5,369,419 | 11/1994 | Stephenson et al. | 347/61 |
| 5,448,279 | 9/1995 | Matsuda et al. | 347/171 |
| 5,573,996 | 11/1996 | Inoue | 503/208 |

FOREIGN PATENT DOCUMENTS

| | | | |
|---|---|---|---|
| 0 543 441 | 5/1993 | European Pat. Off. | B41M 5/00 |

OTHER PUBLICATIONS

Patent Abstracts of Japan, vol. 13, No. 535 (M–899), Nov. 29, 1989 & JP 01 218886 A (Matsushita Graphic Commun Syst Inc), Sep. 1, 1989, *Abstract.

Patent Abstracts of Japan, vol. 18, No. 653 (M–1720), Dec. 12, 1994, & JP 06 255236 A (Fujimori Kogyo K.K.) Sep. 13, 1994, * Abstract.

*Primary Examiner*—N. Le
*Assistant Examiner*—Anh T. N. Vo
*Attorney, Agent, or Firm*—Sughrue, Mion, Zinn, Macpeak & Seas, PLLC

[57] ABSTRACT

The improved thermal recording film includes a clear film base, a thermal recording layer formed on one side of the film base and a matted layer formed on the other side of the film base. The improved method of thermal image recording using a thermal recording film having a thermal recording layer on one side of a clear film base, preferably the improved thermal recording film described above includes the steps of processing the image to be recorded in such a way that the correct image will come out when viewed from the side opposite to the thermal recording layer, and recording the thus processed image on the thermal recording layer in the thermal recording film. The improved thermal recording film and the method of thermal image recording permit the recorded image to be viewed without being affected by abrasions and other defects formed on the image recording surface due to sliding contact with the thermal head, and yet allow for appropriate adjustment of the luster on the image viewing surface, to thereby enable the image to be viewed under more advantageous conditions.

3 Claims, 2 Drawing Sheets

THERMAL RECORDING FILMS AND METHOD OF THERMAL IMAGE RECORDING USING THE SAME

BACKGROUND OF THE INVENTION

This invention relates to the art of thermal recording films for use in thermal image recording and a method of the thermal image recording using said films.

Thermal recording film in which a thermal recording layer is formed on the film base as a support is commonly used to record the images produced in diagnosis by ultrasonic scanning. This recording method, commonly referred to as thermal image recording, eliminates the need for wet processing and offers several advantages including convenience in handling. Hence, the use of the thermal image recording system is not limited to small-scale applications such as diagnosis by ultrasonic scanning and an extension to those areas of medical diagnoses such as MRI and X-ray photography where large and high-quality images are required, is under review.

As is well known, thermal image recording involves the use of a thermal head having a glaze in which heating elements for heating a thermal recording film to record an image are arranged in one direction and, with the glaze in contact with the thermal recording film (thermal recording layer), the two members are moved relative to each other in a direction perpendicular to the direction in which the heating elements are arranged, as the respective heating elements are heated imagewise in accordance with the image to be recorded to heat the thermal recording layer, thereby accomplishing image reproduction.

Thus, in the process of thermal image recording, the thermal head in contact with the thermal film is moved relative to the latter such that the thermal recording layer is heated to effect image recording. In addition, it is not uncommon that the temperature of the thermal head (its glaze) becomes as high as 200° C. and above even in the normal image recording mode. Therefore, many abrasions are formed on the thermal recording layer in the thermal film or sheet on account of sliding with the thermal head and, in an extreme case, such abrasions can interfere with the correct viewing of image.

As a further problem, the luster of the thermal recording layer and, hence, the image recording surface cannot be adjusted appropriately and the uncontrolled luster of the image recording surface can be another cause of interference with the correct viewing of image.

Such abrasion and unnecessary luster not only result in the deterioration of the quality of finished images; they can also cause a serious problem in medical areas by leading to a wrong diagnosis.

SUMMARY OF THE INVENTION

The present invention has been accomplished under these circumstances and has as an object, providing a thermal recording film that permits the recorded image to be viewed without being affected by abrasions and other defects formed on the image recording surface due to sliding contact with the thermal head and which yet allows for appropriate adjustment of the luster on the image viewing surface, and thereby enables the image to be viewed in a more advantageous manner.

Another object of the invention is to provide a method of performing thermal image recording using said thermal recording film.

In order to attain the object described above, the first aspect of the present invention provides a thermal recording film comprising a clear film base, a thermal recording layer formed on one side of the film base, and a matted layer formed on the other side of the film base.

In order to attain another object described above, the second aspect of the invention provides a method of thermal image recording using a thermal recording film having a thermal recording layer on one side of a clear film base, the method comprising the steps of processing the image to be recorded in such a way that the correct image will come out when viewed from the side opposite to the thermal recording layer, and recording the thus processed image on the thermal recording layer in the thermal recording film.

Preferably, the thermal recording film is the one recited above.

DETAILED DESCRIPTION OF THE INVENTION

The thermal recording film of the invention and the method of thermal image recording using the film will now be described in detail with reference to the preferred embodiment illustrated in the accompanying drawings.

Figure 1:
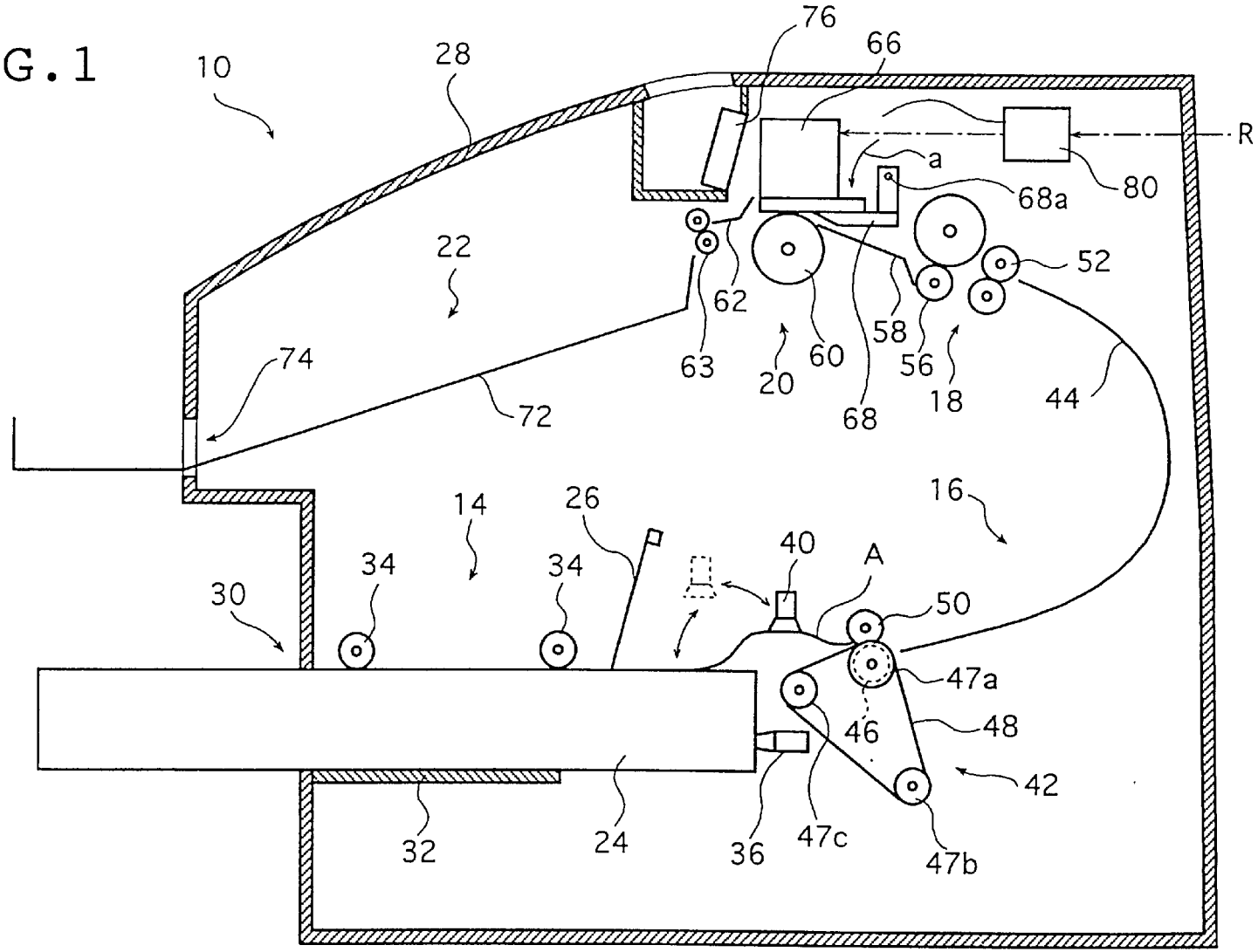
FIG. 1 is a schematic view showing conceptually an embodiment of a thermal image recording apparatus that can be employed to implement the thermal image recording method of the invention.

FIG. 1 shows schematically an embodiment of a thermal image recording apparatus that can implement the thermal image recording method of the invention using the thermal recording films of the invention. The thermal image recording apparatus generally indicated by 10 in FIG. 1 and which is hereunder simply referred to as a "recording apparatus" performs thermal image recording on thermal recording films of a given size, say, B4 (namely, thermal recording films in the form of cut sheets, which are hereunder referred to as "thermal films A"). The apparatus 10 comprises a loading section 14 where a magazine 24 containing thermal films A is loaded, a feed/transport section 16, a record/transport section 18, a recording section 20 performing thermal image recording on the thermal films A by means of the thermal head 66, and an ejecting section 22.

The thermal head 66 is connected to processing means 80 which optionally performs image processing on the image to be recorded on the thermal film A such that it will come out correctly when it is viewed from the side opposite to the recording surface.

Figure 2:
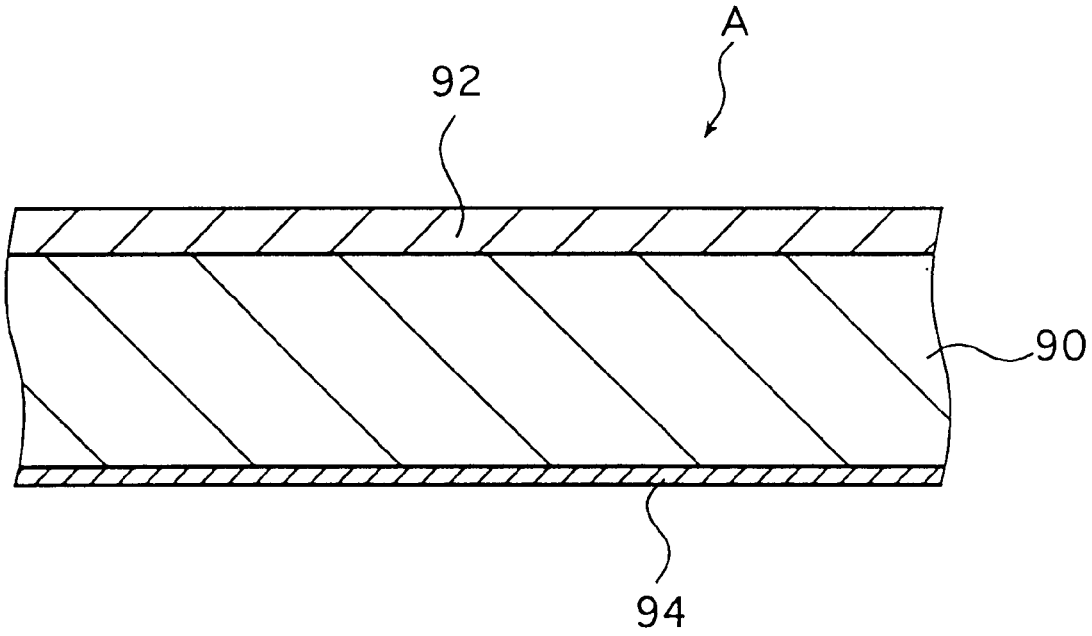
FIG. 2 is a schematic cross section of an embodiment of the thermal recording film of the invention.

FIG. 2 is a cross sectional view showing schematically the thermal film A of the invention. The thermal film A of the invention comprises a film base 90 typically made of clear film such as clear polyethylene terephthalate (PET), which is a support, a thermal recording layer 92 formed on one side of the film base 90 and a matted layer 94 formed on the other side of the film base 90.

The function of the matted layer 94 is to adjust the luster on the image viewing side of the thermal film A from which the user looks at the recorded image and it may be formed by applying a clear paint having fine particles dispersed therein and drying the applied coat. The matted layer 94 provides fine asperities on the surface of the viewing side of the film base 90 such that the incident light will undergo random reflection. Thus, in the thermal film A of the invention, the surface on the side opposite the recording layer 92 is used as a viewing surface and it is rendered "dull" by a matting treatment.

The method of forming the matted layer 94 is in no way limited to the example just described above and any known methods are applicable, such as a method in which a clear paint is applied to a surface of the film base 90 and the applied coat is brought into intimate contact with a surface having an appropriate degree of roughness until the paint dries, and a method in which a surface of the film base 90 is directly processed to form fine asperities.

The luster of the viewing surface can also be adjusted by controlling the surface state (surface roughness which determines the degree of random reflection of light) of the matted layer 94 by a suitable technique depending on the method by which it is formed. If the matted layer 94 is formed by applying a dispersion of fine particles, the luster of the viewing surface can be adjusted by controlling the quality of the dispersed fine particles.

In the thermal film A of the illustrated case, the recording layer 92 is a thermal recording layer of the type that is formed on thermal recording materials such as ordinary thermal films.

As in the case of ordinary thermal films, the thermal film A of the illustrated case is subjected to thermal recording as the thermal head urged against the recording layer 92 moves relative to the film A. Basically, image recording on the thermal film A is performed by the image recording method of the invention (which is hereunder referred to simply as the "recording method"), provided that a reversed image is recorded on the recording layer 92 such that it will come out correctly when viewed from the matted layer 94 on the side which is opposite the side where the recording layer 92 is formed, and the thus recorded image is viewed from the matted layer 94 (i.e., the viewing side).

Thus, using the thermal film A and by applying the recording method of the invention, one can observe the recorded image without any adverse effects of the abrasions and other flaws on the recording surface 92 that have developed on account of sliding contact with the thermal head 66. Furthermore, in spite-of the fact that the (thermal) recording layer 92 cannot usually be subjected to a matting treatment, the thermal film A which has a viewing surface on the side remote from the recording layer 92 is provided with the matted layer 94 and this permits the recorded image to be viewed under appropriately controlled luster conditions.

Typically, such thermal films A are stacked in a specified number, say, 100 to form a bundle, which is either wrapped in a bag or bound with a band to provide a package. In the illustrated recording apparatus 10, the specified number of the thermal films A bundled together with the recording layer 92 facing down are accommodated within the magazine 24 in the recording apparatus 10 and the thermal film A is taken out of the magazine 24 one by one and submitted to the thermal image recording.

The magazine 24 is an enclosure or a casing having a cover 26 freely opened and closed. The magazine 24 containing the thermal films A is loaded in the loading section 14 of the recording apparatus 10. The recording method of the invention may be applicable to the thermal films having no matted layer as well as the thermal films A of the invention having the matted layer 94.

The loading section 14 has an inlet 30 formed in the housing 28 of the recording apparatus 10, a guide plate 32, guide rolls 34 and a stop member 36; the magazine 24 is inserted into the recording apparatus 10 via the inlet 30 in such a way that the portion fitted with the cover 26 is coming first; thereafter, the magazine 24 as it is guided by the guide plate 32 and the guide rolls 34 is pushed until it contacts the stop member 36, whereupon it is loaded at a specified position in the recording apparatus 10.

The feed/transport section 16 has the sheet feeding mechanism using the sucker 40 for grabbing the thermal film A by application of suction, transport means 42 and a transport guide 44; the thermal films A are taken out of the magazine 24 in the loading section 14 and transported to the record/transport section 18 which is located downstream in the direction of film transport.

The transport means 42 is composed of a transport roller 46, a pulley 47*a* coaxial with the roller 46, a pulley 47*b* coupled to a rotating drive source, a tension pulley 47*c*, an endless belt 48 stretched between the three pulleys 47*a*, 47*b* and 47*c*, and a nip roller 50 that is to be pressed onto the transport roller 46. The forward end of the thermal film A which has been sheet-fed by means of the sucker 40 is pinched between the transport roller 46 and the nip roller 50 such that the film A is transported downstream.

When a signal for the start of recording is issued, the cover 26 is opened by the OPEN/CLOSE mechanism (not shown) in the recording apparatus 10. Then, the sheet feeding mechanism using the sucker 40 picks up one sheet of thermal film A from the magazine 24 and feeds the forward end of the thermal film A to the transport means 42 (to the nip between rollers 46 and 50). At the point of time when the thermal film A has been pinched between the transport roller 46 and the nip roller 50, the sucker 40 releases the thermal film A and, the fed thermal film A is supplied by the transport means 42 into the record/transport section 18 as it is guided by the transport guide 44. At the point of time when the thermal film A to be used in recording has been completely ejected from the magazine 24, the OPEN/CLOSE mechanism closes the cover 26.

The record/transport section 18 has a regulating roller pair 52, a transport roller pair 56 and a guide 58. The advancing end of the thermal film A first reaches the regulating roller pair 52. Therefore, the distance between the transport means 42 and the regulating roller pair 52 which is defined by the transport guide 44 is set to be somewhat shorter than the length of the thermal film A in the direction of its transport.

The regulating roller pair 52 are normally at rest. When the advancing end of the thermal film A reaches the regulating roller pair 52, the temperature of the thermal head 66 is checked and if it is at a specified level, the regulating roller pair 52 start to transport the thermal film A. Then, the thermal film A is guided by the guide 58 and transported to the recording section 20 by means of the regulating roller pair 52 and the transport roller pair 56.

The recording section 20 has the thermal head 66, a platen roller 60, a guide 62 and a fan 76 for cooling the thermal head 66. The thermal head 66 is capable of thermal recording at a recording (pixel) density of, say, about 300 dpi. The head comprises a glazed active device for performing thermal recording on the thermal films A and a heat sink fixed to the device. The thermal head 66 is supported on a support member 68 that can pivot about a fulcrum 68*a* either in the direction of arrow a or in the reverse direction.

The platen roller 60 rotates at the preset speed of the image recording to transport the thermal film A in a direction perpendicular to the extending direction of the glaze as thermal film A is held in the specified position. As already mentioned, since the thermal films A are accommodated together with the recording layer 92 facing down within the magazine 24, the platen roller 60 in contact with the matted layer 94 of the thermal film A transports the thermal film A.

Before the thermal film A is transported to the recording section 20, the support member 68 has pivoted to UP position (in the direction opposite to the direction of arrow a) so that the thermal head 66 (or its glaze) is not in contact with the platen roller 60. When the advancing end of the thermal film A being transported by the record/transport section 18 has reached the record START position (i.e., corresponding to the glaze of the thermal head 66), the support member 68 pivots in the direction of arrow a and the thermal film A becomes pinched between the thermal head 66 and the platen roller 60 with the glaze of the thermal head 66 in contact with the recording layer 92, and then the thermal film A is transported downstream as it is held in the specified position by means of the platen roller 60; in the meantime, the thermal head 66 which has the individual heating elements on the glaze for heating imagewise performs thermal recording of the original image on the thermal film A.

In the illustrated recording apparatus 10 which can implement the recording method of the invention, the thermal head 66 is connected to means 80 which processes the image to be recorded on the recording layer 92 such that the correct image will come out when viewed from the matted layer 94; more specifically, the thermal head 66 is connected to means 80 that reverses the image which is to be recorded by the thermal head 66.

As already mentioned, the thermal film A has the transparent film base 90 and is basically characterized in that the matted layer 94 on the side opposite the recording layer 92 is used as a viewing surface. On the other hand, the ordinary image reading apparatus R or the like supplies the thermal head 66 with image information that will produce an image which is to be viewed from the recording layer 92. Therefore, in the recording apparatus 10 for implementing the recording method of the invention, the image delivered from the image reader R or the like is reversed by the processing means 80, then fed to the thermal head 66 which records the reversed image on the recording layer 92.

Thus, according to the recording method of the present invention, the recorded image can be viewed without being adversely affected by the abrasions that were formed on the recording layer 92 by the sliding action of the thermal head 66. The thermal film A has the added advantage of permitting the recorded image to be viewed under properly controlled luster conditions.

The method in which the processing means 80 can employ for image reversing is not limited to any particular type and any known techniques of processing image information may be employed to transpose the recording pixels. In one example, the pixels in the image corresponding to the row of heating elements in the thermal head 66 (or its glaze surface) that have been delivered from the image reader R or the like may be transposed such that they are reversed right and left. More specifically, image reading from the memory or the like which is usually performed from the right to the viewing direction may be replaced by reading from the left.

In addition, the processing means 80 is connected to means for switching the apparatus between two operational modes, one for effecting the reversing of image and the other for not performing the image reversing. If the latter mode is selected, the information on the image to be recorded that is delivered to the thermal head 66 from the image reader R or the like is directly used to perform normal thermal recording and produce an image for viewing from the recording layer 92.

After the end of thermal image recording, the thermal film A as it is guided by the guide 62 is transported by the platen roller 60 and a transport roller pair 63 to be ejected into a tray 72 in the ejecting section 22. The tray 72 projects exterior to the recording apparatus 10 via the outlet 74 formed in the housing 28 and the thermal film A carrying the recorded image is ejected via the outlet 74 for takeout by the operator.

On the foregoing pages, the thermal recording films and the thermal image recording method of the invention have been described in detail but the present invention is in no way limited to the stated embodiments and various improvements and modifications can of course be made without departing from the spirit and scope of the invention.

As described above in detail, the thermal recording film of the invention and the method of thermal image recording using said film have the advantage of permitting the recorded image to be viewed without being affected by abrasions and other defects formed on the image recording surface due to sliding contact with the thermal head and yet allowing for appropriate adjustment of the luster on the image viewing surface to thereby enable the image to be viewed under more advantageous conditions. This advantage is particularly significant in medical areas since errors in diagnosis due to difficulties in image viewing can be considerably reduced.

What is claimed is:

1. A thermal recording film comprising:

a clear film base;

a thermal recording layer formed on one side of said film base and adjacent to said film base; and means for adjusting a luster on a viewing side of said thermal recording film, such that incident light on said viewing side will undergo a random reflection, said viewing side being on the other side of said film base;

wherein a surface on the viewing side, which is opposite the thermal recording layer, is used as a viewing surface.

2. A method of thermal image recording using a thermal recording film comprising a thermal recording layer disposed on one side of a clear film base, and a viewing surface located on the other side of the clear film base, said method comprising the steps of:

delivering an image from an image reader to a processing means;

processing the image in the processing means by reversing the image;

delivering the processed image to a thermal head;

recording the processed image on the thermal recording layer of said thermal recording film; and viewing the processed image on the thermal recording layer from the other side of said clear film base, from the viewing surface located opposite the thermal recording layer.

3. The method according to claim 2, wherein said thermal recording film further comprises:

means for adjusting a luster on the viewing surface, such that incident light on the viewing surface will undergo a random reflection.

* * * * *